US011617936B2

(12) United States Patent
Behrmann

(10) Patent No.: US 11,617,936 B2
(45) Date of Patent: Apr. 4, 2023

(54) VOLLEYBALL SETTER TRAINING GLOVE

(71) Applicant: Hannah Rose Behrmann, Tega Cay, SC (US)

(72) Inventor: Hannah Rose Behrmann, Tega Cay, SC (US)

( * ) Notice: Subject to any disclaimer, the term of this patent is extended or adjusted under 35 U.S.C. 154(b) by 0 days.

(21) Appl. No.: 17/402,859

(22) Filed: Aug. 16, 2021

(65) Prior Publication Data

US 2021/0370155 A1 Dec. 2, 2021

Related U.S. Application Data

(63) Continuation of application No. 16/292,395, filed on Mar. 5, 2019, now abandoned.

(51) Int. Cl.

| | |
|---|---|
| ***A63B 71/14*** | (2006.01) |
| ***A63B 69/00*** | (2006.01) |
| ***A41D 19/015*** | (2006.01) |

(52) U.S. Cl.

CPC ..... *A63B 71/148* (2013.01); *A41D 19/015* (2013.01); *A63B 69/0095* (2013.01)

(58) Field of Classification Search

CPC . A63B 71/148; A63B 69/0095; A63B 69/002; A41D 19/015

See application file for complete search history.

(56) References Cited

U.S. PATENT DOCUMENTS

| | | | | |
|---|---|---|---|---|
| 2,474,030 | A * | 6/1949 | Braswell | A63B 71/146 2/161.2 |
| 2,611,901 | A * | 9/1952 | Markneider | A41D 19/01 D2/611 |
| 3,725,957 | A * | 4/1973 | Shotmeyer | A63B 71/146 2/161.1 |
| 4,587,673 | A * | 5/1986 | Boliard | A63B 71/148 D29/117.1 |
| D290,304 | S * | 6/1987 | Fink | D2/617 |
| 4,843,651 | A * | 7/1989 | Gramza | A63B 71/148 2/163 |
| 6,006,358 | A * | 12/1999 | Keating | A63B 71/148 473/464 |
| 7,904,967 | B1 * | 3/2011 | Cummings | A63B 71/145 2/18 |
| 8,075,427 | B2 * | 12/2011 | Millsap | A63B 69/0095 473/422 |
| 8,434,164 | B2 * | 5/2013 | Clark | A63B 71/148 2/161.3 |
| 9,003,569 | B2 * | 4/2015 | Ramirez | A63B 71/141 2/163 |
| 9,055,774 | B2 * | 6/2015 | Gambordella | A63B 71/141 |
| 10,525,320 | B2 * | 1/2020 | Thomas | A63B 63/00 |
| 11,148,030 | B2 * | 10/2021 | Thomas | A63B 71/0622 |
| 2008/0010718 | A1 * | 1/2008 | Richards | A41D 19/0013 2/159 |
| 2010/0186140 | A1 * | 7/2010 | Ramirez | A41D 19/0017 2/163 |
| 2010/0229280 | A1 * | 9/2010 | Robinson | A61C 7/14 2/158 |

(Continued)

*Primary Examiner* — Alissa L Hoey
(74) *Attorney, Agent, or Firm* — NK Patent Law

(57) ABSTRACT

An apparatus comprising a pair of gloves, wherein an index finger portion of a left glove is connected to an index finger portion of a right glove, and wherein a thumb portion of the left glove is connected to a thumb portion of the right glove.

8 Claims, 4 Drawing Sheets

(56) References Cited

U.S. PATENT DOCUMENTS

| | | | | |
|---|---|---|---|---|
| 2011/0041235 | A1* | 2/2011 | Harris | A41D 19/01582 2/163 |
| 2012/0083369 | A1* | 4/2012 | Millsap | A63B 69/0095 473/464 |
| 2015/0282538 | A1* | 10/2015 | Ramirez | A41D 19/0017 2/160 |
| 2015/0335983 | A1* | 11/2015 | Perri | A63B 71/148 2/161.1 |
| 2017/0319942 | A1* | 11/2017 | Miller | A63B 71/141 |
| 2018/0043232 | A1* | 2/2018 | Perry | A63B 71/148 |
| 2020/0037683 | A1* | 2/2020 | Ramirez | A41D 19/01523 |
| 2021/0077890 | A1* | 3/2021 | Chorne | G09B 19/0038 |

* cited by examiner

VOLLEYBALL SETTER TRAINING GLOVE

CROSS-REFERENCE TO RELATED APPLICATION(S)

This application is a continuation of U.S. patent application Ser. No. 16/292,395 filed Mar. 5, 2019, entitled "VOLLEYBALL SETTER TRAINING GLOVE", the entire content of which is incorporated by reference herein.

TECHNICAL FIELD

This disclosure relates to a volleyball instructional apparatus and methods of using such apparatus, more particularly to a glove set for learning and practicing certain aspects of the volleyball game including training a user on practicing how to establish proper hand, forearm, wrist and/or fingers positioning when setting a ball during different volleyball motions.

BACKGROUND

In the game of volleyball, the player playing in the setter position (hereinafter "setter") needs to "set" the volleyball in an ideal position (e.g., a proper height and in a proper location based on the situation) in order for a fellow player ("hitter") from the same team to hit the volleyball towards a predetermined location within the court area of the opposition team to thereby score a point for the team. A beginner volleyball setter needs to learn and practice proper setting techniques in order to have better control of the set. It often requires many hours of practice to improve and/or perfect the setting techniques.

Opportunities exist for assisting a novice volleyball setter in learning the proper setting techniques in an expedient manner.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Disclosed herein is an apparatus including a pair of gloves, wherein an index finger portion of a left glove is connected to an index finger portion of a right glove, and wherein a thumb portion of the left glove is connected to a thumb portion of the right glove.

According to one or more embodiments, a wrist portion of each glove includes a securing mechanism for securing the glove about the wrist of a person.

According to one or more embodiments, the securing mechanism comprises one or more of staple, buckle, snap, lace, adhesive and other bonding or contacting material.

According to one or more embodiments, a wrist portion of each glove includes a hook and loop mechanism for securing the glove about the wrist of the person.

According to one or more embodiments, a palm portion of each glove is formed of leather.

According to one or more embodiments, a thumb portion and a plurality of finger portions of each glove are formed of fabric.

According to one or more embodiments, the index finger portions are sized such that ends of index fingers of a person wearing the gloves are spaced apart from each other by at least 0.50 inches.

According to one or more embodiments, the thumb portions are sized such that ends of thumbs of a person wearing the gloves are spaced apart from each other by at least 0.50 inches.

According to one or more embodiments, the gloves are configured for the middle finger, ring finger and little finger of a person wearing the gloves to extend outside of respective finger portions of the gloves.

According to one or more embodiments, one or more of the thumb portion and a plurality of finger portions are provided with one or more vents for moisture escape.

According to one or more embodiments, a continuous inner edge bounded by the thumb portions, the index finger portions and palm portions of the gloves approximates a triangle shape when the gloves are spread on a flat surface.

According to one or more embodiments, a wrist portion of the gloves has a width of at least 1.5 inches.

According to one or more embodiments, spacing between the thumb portions is adjustable.

According to one or more embodiments, spacing between the index finger portions is adjustable.

According to one or more embodiments, at least one of the thumb portions and the index finger portions comprises an elastic material.

According to one or more embodiments, the gloves comprises one or more of polyurethane, polyester, nylon, spandex, elastane, plastic, cloth, rubber, canvas, tarp leather silicone and neoprene materials.

According to one or more embodiments, the apparatus further comprises an elbow protection member detachably attached to the each of the left and right gloves.

According to one or more embodiments, the elbow protection member approximates a sleeve or cuff comprising a flexible material.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

DETAILED DESCRIPTION OF THE EMBODIMENTS

Figure 1:
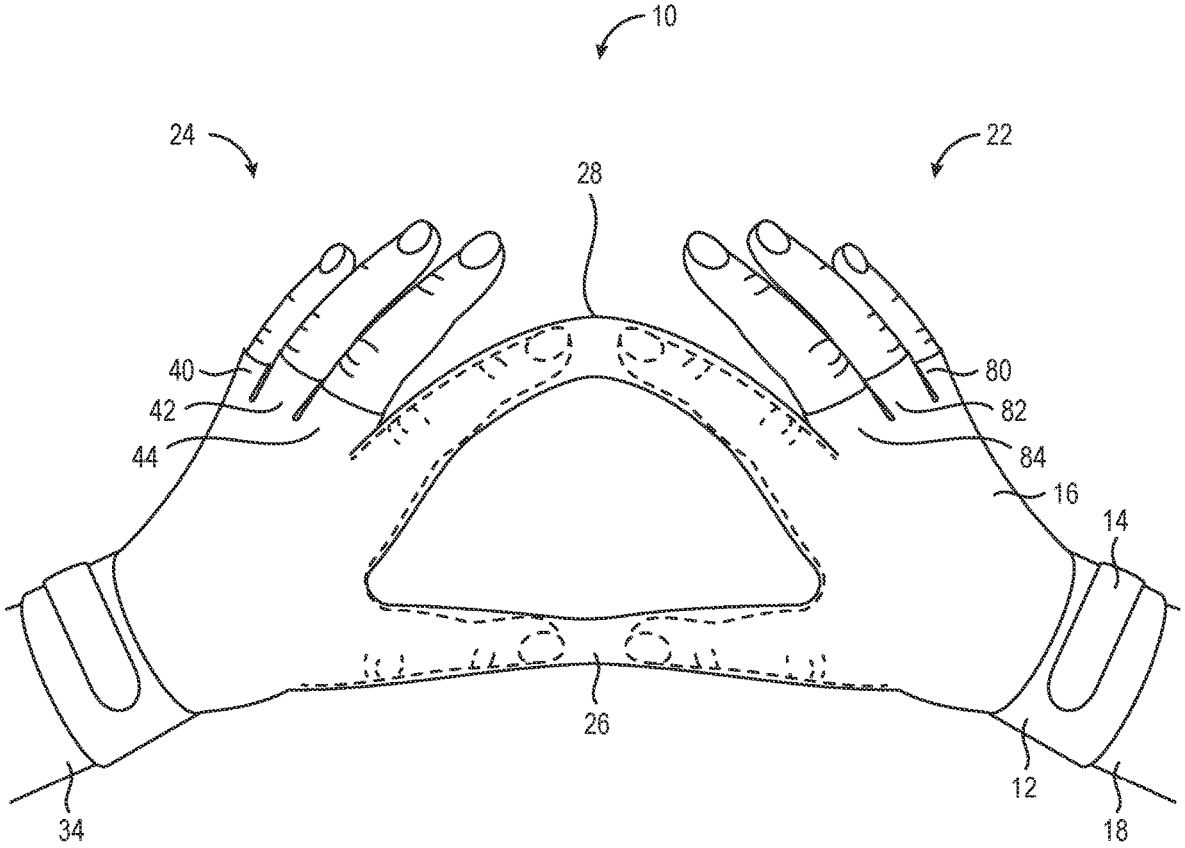
FIG. 1 is a schematic structural diagram of a volleyball setter training glove set worn by a person with palms facing away from page according to one or more embodiments of the present invention.

Below, the technical solutions in the examples of the present invention are depicted clearly and comprehensively with reference to the figures according to the examples of the present invention. Obviously, the examples depicted here are merely some examples, but not all examples of the present invention. In general, the components in the examples of the present invention depicted and shown in the figures herein can be arranged and designed according to different configurations. Thus, detailed description of the examples of the present invention provided in the figures below are not intended to limit the scope of the present invention as claimed, but merely represent selected examples of the present invention. On the basis of the examples of the present invention, all of other examples that could be obtained by a person skilled in the art without using inventive efforts will fall within the scope of protection of the present invention. The present invention will be further described with reference to the accompanying drawings:

When making an overhead pass during a volleyball game, putting the ball in a good position for the hit is advantageous in scoring points. The player playing in the setter position ("setter") needs to "set" the volleyball in an ideal position (e.g., a proper height and in a proper location based on the situation) in order for a fellow player ("hitter") from the same team to hit the volleyball towards an appropriate location of the court area of the opposition team to hopefully score a point. A beginner volleyball setter, for example, needs to learn and practice proper setting techniques in order to have better control of the set. A volleyball setter training glove as described herein may assist a volleyball setter, particularly a novice, to learn setting the volleyball in an expedient manner; it may also assist an established volleyball setter to improve the setter's setting techniques.

The volleyball setter training glove set (alternately referred to herein as "glove", "gloves" and "glove set") as described herein is a training device that may be worn on a volleyball setter's hands to learn and practice proper hand and wrist technique for optimal volleyball setting during a game of volleyball. In addition, the glove set may also help a setter position the hands to use the correct muscles, predominantly in the wrist region, during the setting of the volleyball, thereby strengthening wrists through maintaining the proper technique on a consistent basis.

The glove set as described herein supports proper technique by: (1) ensuring that the thumbs and the index fingers of the setter wearing the glove set are spread out within the gloves in the shape that mimics that of the volleyball and forms a triangular window through which the setter can view the ball, (2) ensuring that the thumb and fingers of one hand does not come into contact with the thumb and/or fingers of the other hand as the volleyball is being contacted during the setting process, (3) ensuring that the fingers, and not the palms, make contact with the volleyball, (4) ensuring that a bigger portion of the volleyball's surface area makes contact with the setter's fingers whereby the setter has better control of the set, (5) ensuring that the glove isolates the fingers of one hand from that of the other, at least at the instant when the ball comes in contact with the setter's hands thereby forcing the setter to predominately engage the wrist muscles for setting the ball as the arms fully extend before, during, and after contact with the ball, according to one or more embodiments of the present invention.

One advantageous aspect of the glove set is that it may help/force the setter to use wrists (instead of fingers) to set the ball. Often experienced setters have learned incorrect setting techniques whereby they primarily use their fingers to set the ball. Ideally, the fingers should be used to keep the ball in position and balanced, and the wrists should be used for controlling the ball and sending it to the intended target location. Using the wrists to set the ball is preferable. The glove set as disclosed herein may advantageously help correct incorrect techniques that many experienced setters have developed whereby by practicing with the gloves, setters can learn proper technique, and ultimately, improve their sets. This is true for novice setters as well, who often tend to use both the fingers and palms when setting the ball. The glove set as described herein may advantageously assist novice players learn to use their wrists to set the ball. The glove set may accordingly advantageously ensure that a setter engages the wrists to set the ball. The glove set may help keep hands together in a specific way, which may force the wrists to do the work. Specifically, the glove set may restrict certain finger muscles, allow the ball to be contacted with arms bent at the proper height, and thereby ensure that the wrist muscles do the work to set the ball. In addition, the glove set may impart resistance, which may help build the wrist muscles.

Embodiments of the present invention provide a glove set which may advantageously accelerate the learning of proper setting techniques by a volleyball setter, especially a novice volleyball setter. Embodiments of the present invention may also provide an apparatus which maintains proper spacing between the thumbs and between the index fingers of the setter wearing the glove set during the setting of the volleyball in a manner that does not limit the flexibility of the setter's fingers while using the apparatus. Other advantages of the present invention are its convenience, ease of use and affordability. Children and adults alike can improve their setting technique. The volleyball setter training glove set as described herein is designed to establish a higher precision and/or greater accuracy of ball placement, and overall better performance of properly setting the volleyball, or any combination thereof, compared to known techniques or other volleyball instructional apparatus. Embodiments of the present invention may be used for practice, recreation, and/or competition. Still further advantages of the invention will become readily apparent to those skilled in the art to which the invention pertains upon reference to the following detailed description.

One advantageous aspect of the volleyball setter training glove set is that it is configured such that the left and right gloves of the glove set are connected in a specific manner as shown, for example, in FIG. 1 to ensure that the hands of the setter are advantageously positioned for an ideal setting technique.

FIG. 1 illustrates one embodiment of a volleyball setter training glove set 10 including a pair of glove (i.e., a left glove and a right glove), wherein an index finger portion of the left glove is connected to an index finger portion of the right glove, and wherein a thumb portion of the left glove is connected to a thumb portion of the right glove. As shown in FIG. 1, glove set 10 includes a left glove 24 and a right glove 22. Glove set 10 further includes a joint index finger portion 28 and a joint thumb portion 26. In the illustration of FIG. 1, the palms of the wearer of the glove set are facing away from page. In one embodiment, the joint index finger portion 28 may be formed by inserting a cylindrical flexible material (hollow or otherwise) between an open index finger portion of the left glove and an open index finger portion of the right glove; the insertion being attached using glue, stitching or similar other techniques. In another embodiment, the joint index finger portion 28 may be manufactured such it is of a continuous uninterrupted construction. Similar techniques may be employed in the fabrication of joint thumb portion 26 and joint index finger portion 28.

Right glove 22 fits into right wrist 18 of a person and includes main glove portion 16 from which small finger portion 80, ring finger portion 82 and middle finger portion 84 extend. Right glove 22 further includes a wrist portion 12 including a fastening mechanism 14 for securing the right glove about wrist 18. Similarly, left glove 24 fits into left wrist 34 of a person and includes main glove portion (not labeled) from which small finger portion 40, ring finger portion 42 and middle finger portion 44 extend. Left glove 24 further includes a wrist portion (not labeled) including a fastening mechanism (not labeled) for securing left glove 24 about wrist 34.

Figure 2:
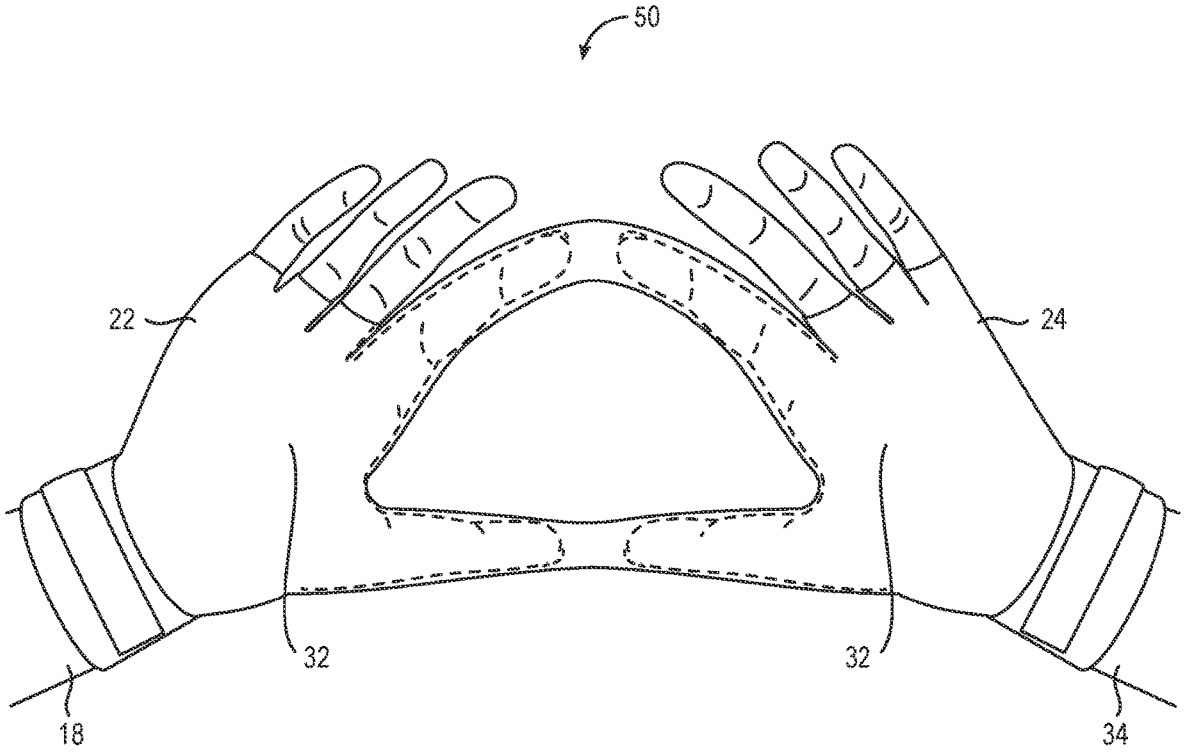
FIG. 2 is a schematic structural diagram of the volleyball setter training glove set of FIG. 1 with palms facing the page according to one or more embodiments of the present invention.
Figure 3:
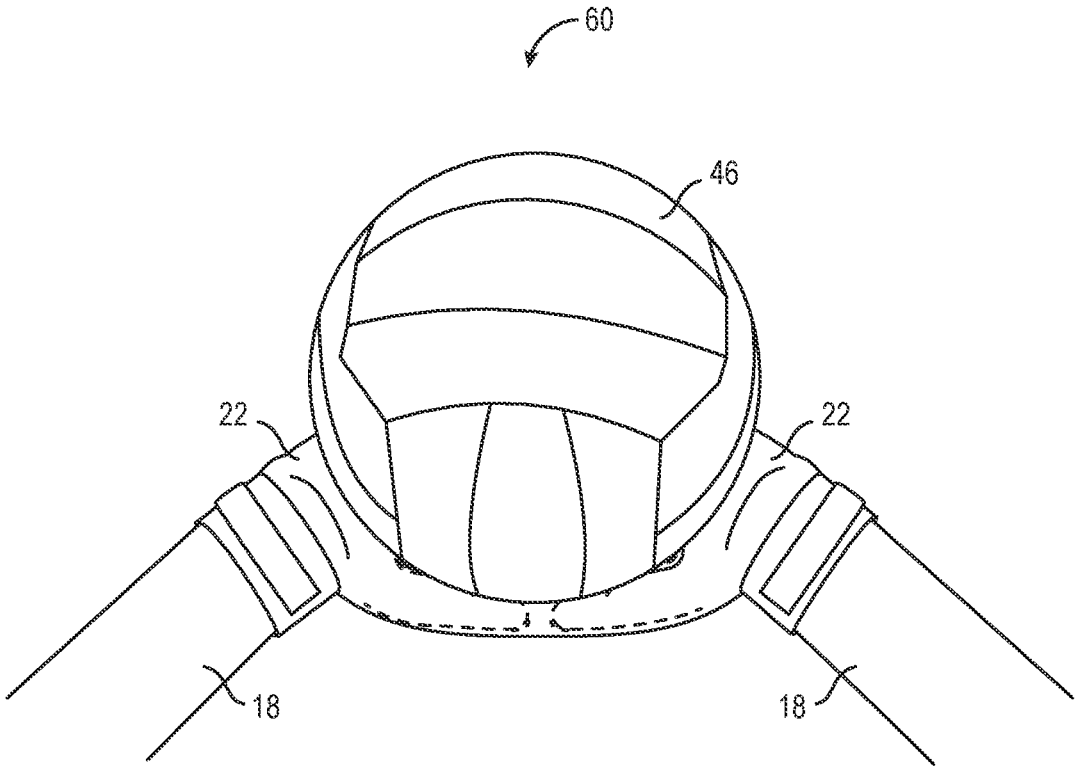
FIG. 3 is a schematic structural diagram of the volleyball setter training glove set worn by a person making contact with volleyball with the person's palms facing the page according to one or more embodiments of the present invention.
Figure 4:
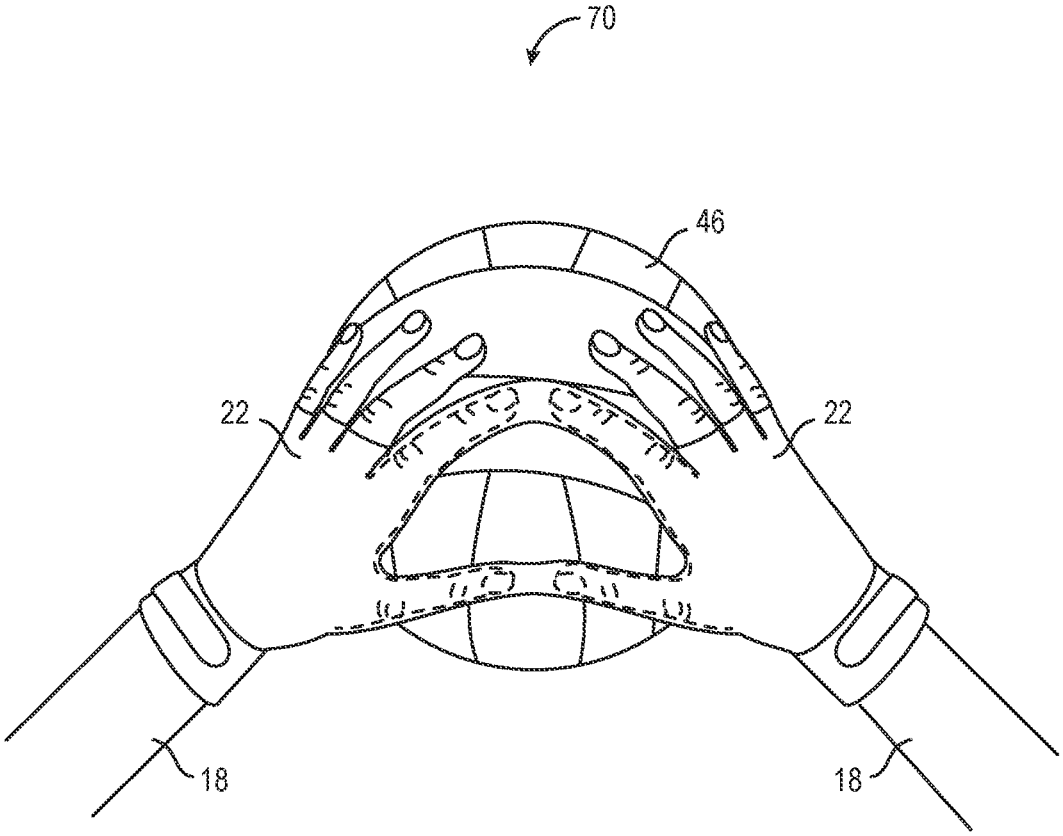
FIG. 4 is a schematic structural diagram of the volleyball setter training glove set worn by a person making contact with volleyball with the person's palms facing away from the page according to one or more embodiments of the present invention.

FIG. 2 illustrates the glove set 10 of FIG. 1 with the palms of the wearer facing the page. As shown in FIG. 2, each of the gloves 22, 24 includes a front side 32, according to one or more embodiments of the present invention. FIG. 3 illustrates volleyball setter training glove set 10 making contact with volleyball 46 with palms of the wearer facing the page according to one or more embodiments of the present invention. FIG. 4 illustrates volleyball setter training glove set 10 making contact with volleyball 46 with palms of the wearer facing away from the page according to one or more embodiments of the present invention.

As illustrated in FIG. 1, wrist portion 12 of each glove includes a securing mechanism 14 for securing the glove about the wrist of a person. In various embodiments, the securing mechanism 14 comprises one or more of the following securing mechanisms: staple, buckle, snap, lace, adhesive and other bonding or contacting material. In one embodiment, the wrist portion of each glove includes a hook and loop mechanism for securing the glove about the wrist of the person.

In one embodiment, the main glove portion and/or the palm portion of each glove is formed of leather or leather like material. In the same embodiment or in a different embodiment, one or more of the thumb portion and a plurality of finger portions of each glove are formed of fabric or a similar other flexible material.

In one embodiment, the joint index finger portions 28 are sized such that ends of index fingers of a person wearing the glove set are spaced apart from each other by at least 0.50 inches. In the same or in a different embodiment, the joint thumb portions 26 are sized such that ends of thumbs of a person wearing the glove set are spaced apart from each other by at least 0.50 inches. In another embodiment for use by a smaller person such as a child, the joint thumb portions of the glove set are sized such that ends of thumbs of a person wearing the glove set are spaced apart from each other by at least 0.25 inches; similarly, the joint index finger portions are sized such that ends of index fingers of a person wearing the glove set are spaced apart from each other by at least 0.25 inches. In another embodiment, the spacing between the index fingers is set at least 0.75 inches; similarly, the spacing between the thumbs is set at least 0.75 inches. The exact spacing clearance is not important, just that it is preferable for them to be spaced apart.

In several embodiments, the glove set is configured such that the middle finger, ring finger and little finger of a person wearing the glove set extend outside of respective finger portions of the glove set. Alternately, in some embodiments, one or more of the fingers and thumbs may be fully enclosed by the glove set.

In various embodiments, one or more of the thumb portion and a plurality of finger portions of the glove set are provided with one or more apertures or vents making it breathable to air and moisture. In one embodiment, the vent/aperture may be in the form of a net that has elasticity and/or is otherwise flexible.

In various embodiments, the continuous inner edge bounded by the thumb portions, the index finger portions and the palm or main glove portions of the glove set approximates a triangle shape when the glove set is spread out, as illustrated, for example, in FIGS. 1 and 2.

In one embodiment, wrist portion 12 of each glove of the glove set has a width of at least 1.5 inches. In other embodiments, the wrist portion may be configured to be wider or narrower depending on the needs of the potential wearer, and particularly the wrist size of the wearer.

In some embodiments, spacing between the thumb portions may be adjustable. In one embodiment, this is accomplished by a hook and loop mechanism that permits the thumb portion of one glove to slide in and out of the thumb portion of the other glove, with the thumb portions being secured at a desired position with hook and loop or any other suitable securing mechanisms. For example, in other embodiments, other securing mechanisms such as, for example, staple, buckle, snap, lace, adhesive and other bonding or contacting materials may be used to facilitate the adjustment feature. In one embodiment, spacing between the index finger portions too may be adjustable, the adjustment being facilitated by the same features and/or materials as those providing adjustability of spacing between the thumb portions as described above.

In one embodiment, at least one of the thumb portions and the index finger portions comprises an elastic material. In another embodiment, the thumb portions and several of the finger portions shown in FIG. 1 include elastic material.

In various embodiments, each glove comprises one or more of leather, leather like material, polyurethane, polyester, nylon, spandex, elastane, plastic, cloth, rubber, canvas, tarp leather silicone and neoprene materials.

In some embodiments, the apparatus further comprises an optional elbow protection member detachably attached to the each of the left and right gloves. In one embodiment, the elbow protection member approximates a hollow cylinder comprising a flexible material. The elbow protection member may provide support to the elbow region, and the regions adjoining the elbow region, of the volleyball setter.

In one embodiment, the material found in between adjacent finger portions as well as the material found in between the thumb portion and an adjacent index finger portion is formed of a flexible material such as, for example, fabric to allow for bending and movement. In a further embodiment, the material on the palm region of the glove set 10 may be a material, such as stretch leather, leather-like material, or a similar other material, to ensure relative firmness; using such materials may ensure that each glove of the glove set are positioned firmly on the setter's hands without any undesirable movements occurring during the setting process. In various embodiments, the glove material on the upper surface of the glove set (i.e., the surface that covers that portion of the hand on the opposite side as the palm) is made up of a flexible fabric to facilitate bending and movement. As noted earlier, in some embodiments, upper portions of the middle, ring and little fingers of the wearer of the glove set may be exposed, with little to no part of the glove material covering them in order to facilitate the setter's fingers in making direct contact with the volleyball.

In one embodiment, when the glove set 10 is worn by the setter and the fastening mechanism 14 is strapped over the wrist portion 12, at least a portion of each wrist of the setter is securely covered by tight flexible material at least one inch wide, preferably 1.5 inches or more wide, thereby ensuring that each of the left and right gloves is secured to the setter's hand and wrist in a strong and firm hold. In one embodiment, the fastening mechanism 14 may comprise hook and loop fasteners to facilitate easy on-and-off and for ease of adjustment of the fastening mechanism based on the wrist size of the setter.

In various embodiments, the glove set may further include decorative pictures or graphics or materials and/or text on the surface of the glove set.

Whereas the glove set is described herein with regard to use in training a volleyball setter in proper setting techniques, its use need not be limited to use in volleyball applications. In other words, the glove set may be used in any and all other applications wherein attaching the left and right gloves in the manner explained and illustrated herein may be desirable; for example, the techniques explained herein may find use in applications such as holding, lifting, pulling, pushing, moving, obstructing and similar other application with regard to an item that the wearer of the glove set may interact with. For example, the glove set as described herein may assist in providing additional support and grip when the wearer is attempting to lift a heavy item from the floor/ground, for example. Further, in some applications (including in the volleyball playing applications), it may be desirable to configure the glove set such that the index fingers and/or the thumbs may be allowed to come in contact with each other, for example, by reducing the span of the thumb portions and/or the index finger portions.

Further, in other embodiments, the left glove and the right glove may be detachably attached to each other by a fastener mechanism such as, for example hook and loop fasteners, staples, buckles, snaps, laces, and similar other materials. In some embodiments, such a detachable attachment may be desirable to prevent permanent damage to the glove set, for example, when excessive force may be applied in a manner such that each glove is pulled away from the other. Furthermore, in some embodiments, the thumb portion and a plurality of finger portions may completely enclose the thumbs and the fingers respectively of the wearer of the glove set. The detachable mechanism may be advantageous in soccer goalkeeping applications.

Other applications of the glove set as described herein include use by a soccer goalkeeper for learning, practicing and improving their goalkeeping skills. While a volleyball setter positions the hands generally above their head, a volleyball goalkeeper positions the hands in front of their body and above their body as needed. In a soccer application, it may be desirable for the gloves to be have the detachably attachable feature.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A training apparatus for volleyball setting training, the apparatus comprising:

a left hand glove and a right hand glove, wherein the left hand glove and the right hand glove each comprise a glove material, wherein the left hand glove and the right hand glove each include an index finger sleeve, a middle finger sleeve, a ring finger sleeve, a little finger sleeve, a thumb sleeve, a palm portion, and a wrist portion, wherein the index finger sleeve of the left hand glove is continuously, uninterruptedly connected to the index finger sleeve of the right hand glove to form a continuously, uninterruptedly index finger sleeve, wherein the thumb sleeve of the left hand glove is continuously, uninterruptedly connected to the thumb sleeve of the right hand glove to create a continuously, uninterruptedly thumb sleeve, wherein the continuously, uninterruptedly index finger sleeve is continuously, uninterruptedly connected to the continuously, uninterruptedly thumb sleeve, and wherein each middle finger sleeve, ring finger sleeve, and little finger sleeve includes a terminal opening, such that a person's middle finger, ring finger, and little finger are configured to extend outside of the respective terminal opening of each middle finger sleeve, ring finger sleeve, and little finger sleeve when worn.

2. The apparatus of claim 1, wherein the wrist portion of each glove includes a hook and loop mechanism for securing the glove about a wrist of the person.

3. The apparatus of claim 1, wherein the glove material is formed of fabric.

4. The apparatus of claim 1, wherein the continuously, uninterruptedly index finger sleeve is sized such that the ends of index fingers of a person wearing the gloves are spaced apart from each other by at least 0.25 inches.

5. The apparatus of claim 1, wherein the continuously, uninterruptedly thumb sleeve is sized such that the ends of thumbs of a person wearing the gloves are spaced apart from each other by at least 0.25 inches.

6. The apparatus of claim 1, wherein the wrist portion of the gloves has a width of at least 1.5 inches.

7. The apparatus of claim 1, wherein at least one of the thumb sleeves and the index finger sleeves comprises an elastic material.

8. The apparatus of claim 1, wherein the glove material comprises one or more of polyurethane, polyester, nylon, spandex, elastane, plastic, cloth, rubber, canvas, tarp leather silicone and neoprene material.

* * * * *